US007275790B2

(12) United States Patent
Chi

(10) Patent No.: US 7,275,790 B2
(45) Date of Patent: Oct. 2, 2007

(54) BACKREST ELEVATION ADJUSTMENT ASSEMBLY

(76) Inventor: Ching-Hui Chi, No. 157, Fuhsing Rd., Lin 15, Wen Hua Li, Taoyuan City (TW)

( * ) Notice: Subject to any disclaimer, the term of this patent is extended or adjusted under 35 U.S.C. 154(b) by 298 days.

(21) Appl. No.: 11/107,797

(22) Filed: Apr. 18, 2005

(65) Prior Publication Data

US 2006/0232115 A1 Oct. 19, 2006

(51) Int. Cl.
*A47C 7/40* (2006.01)

(52) U.S. Cl. ..... 297/353; 297/440.21

(58) Field of Classification Search ..... 297/353, 297/301.1, 440.21

See application file for complete search history.

(56) References Cited

U.S. PATENT DOCUMENTS 4,012,158 A * 3/1977 Harper ..... 403/107
4,451,084 A * 5/1984 Seeley ..... 297/353
4,616,877 A * 10/1986 Slaats et al. ..... 297/353
5,685,609 A * 11/1997 Miotto ..... 297/353
5,725,278 A * 3/1998 Verbeek ..... 297/353
5,918,938 A * 7/1999 Miotto ..... 297/353
6,264,276 B1 * 7/2001 Chen ..... 297/353

* cited by examiner

*Primary Examiner*—Joe Edell
(74) *Attorney, Agent, or Firm*—Leong C. Lei

(57) ABSTRACT

A backrest elevation adjustment assembly is provided, which is mainly composed of an L-shape member, a sliding member, and a multi-step positioning member. A seat supporting board is attached to the horizontal section of the L-shape member and the sliding member, which is attached to a backrest supporting board, is installed on the vertical section of the L-shape member, surrounding the multi-step positioning member embedded in the vertical section of the L-shape member. The sliding member could be slid up and down along the vertical section of the L-shape member and fixed at a number of pre-determined positions provided by the multi-step positioning member. With the elevation adjustment assembly, a chair's backrest could be adjusted to suit a sitter's specific posture so as to achieve comfortable seating.

5 Claims, 7 Drawing Sheets

BACKREST ELEVATION ADJUSTMENT ASSEMBLY

BACKGROUND OF THE INVENTION (a) Technical Field of the Invention

The present invention generally relates to chairs, and more specifically to an assembly for adjusting the elevation of a chair's backrest to a number of predetermined positions.

(b) Description of the Prior Art

To provide comfortable seating, a chair's backrest should be designed with a curved cushion which leans slightly backward for supporting a sitter's waist and back. Further more, as each person has his or her own physical characteristics, the vertical position of the backrest should be adjustable to fit the sitter's specific posture. However, currently most adjustable chairs found in offices only allow a sitter to adjust the degree of reclining of the backrest and the backrest usually has a fixed vertical position based on the average posture of an ordinary person.

SUMMARY OF THE INVENTION

The primary purpose of the present invention is to provide a backrest elevation adjustment assembly so that the vertical position of a chair's backrest could be adjusted. The elevation adjustment assembly is mainly composed of an L-shape member, a sliding member, and a multi-step positioning member. A seat supporting board is attached to the horizontal section of the L-shape member and the sliding member, which is attached to a backrest supporting board, is installed on the vertical section of the L-shape member, surrounding the multi-step positioning member embedded at an appropriate location in the vertical section of the L-shape member. The sliding member could be slid up and down along the vertical section of the L-shape member and fixed at a number of pre-determined positions provided by the multi-step positioning member. With the elevation adjustment assembly, a chair's backrest could be adjusted to suit a sitter's specific posture so as to achieve comfortable seating.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1A:
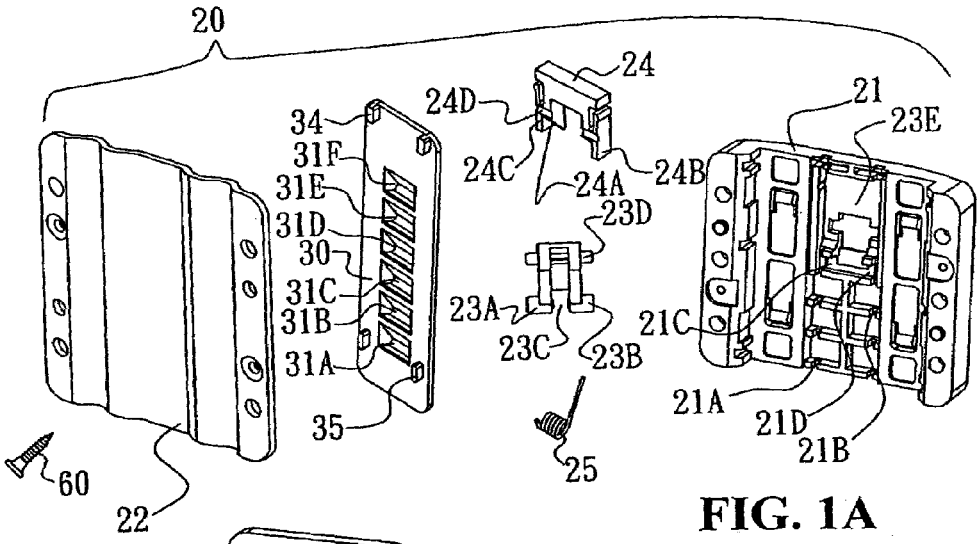
FIGS. 1A, 1B, 1C is a perspective view showing the various components making up an embodiment of the present invention.
Figure 1B:
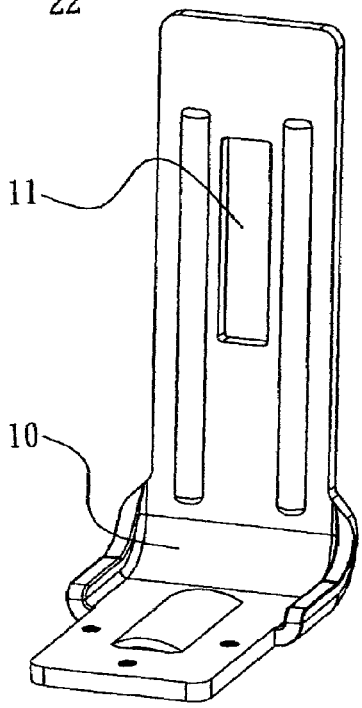
Figure 1C:
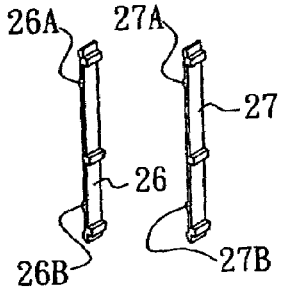
Figure 2:
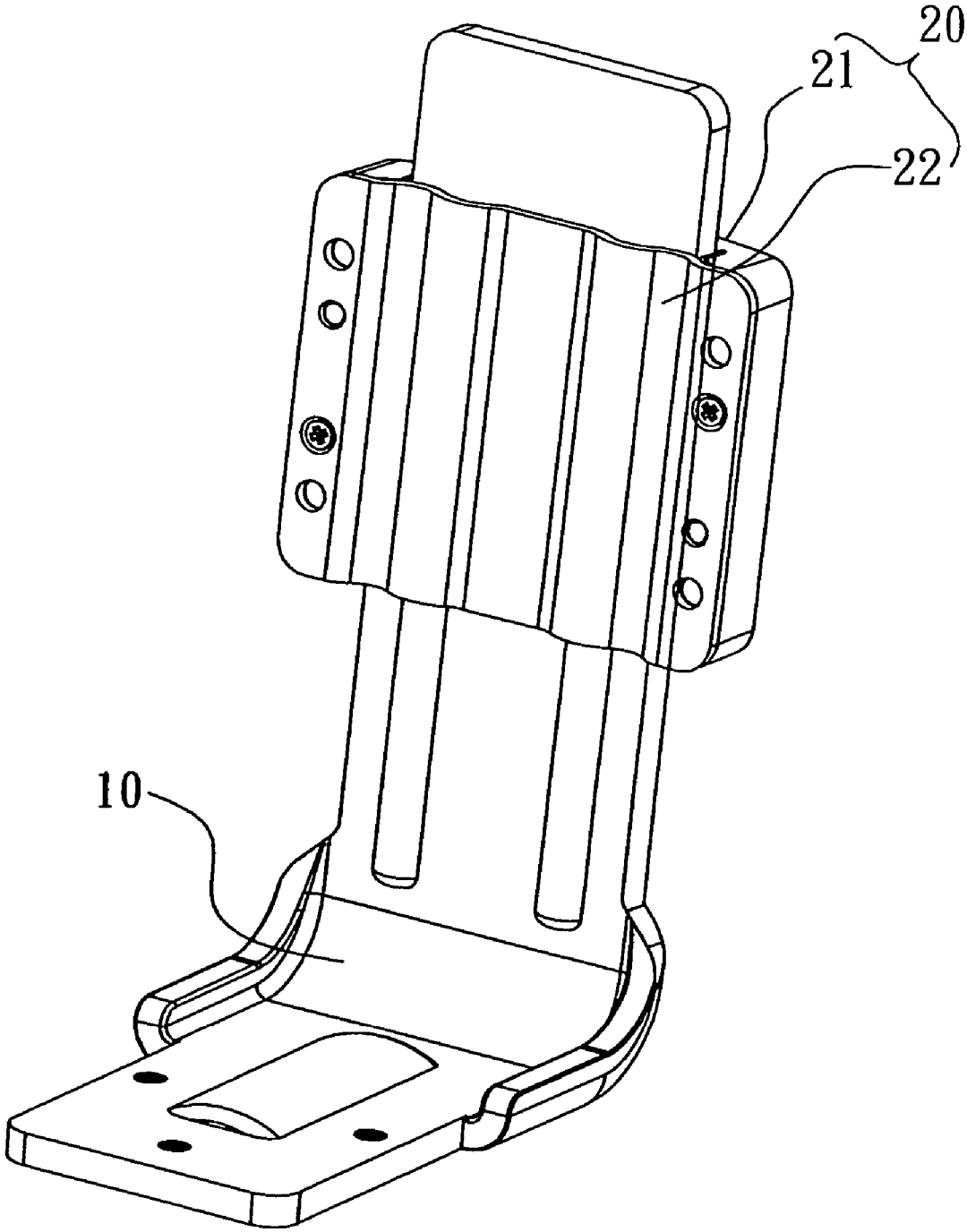
FIG. 2 is a perspective view showing an embodiment of the present invention when it is assembled.
Figure 3:
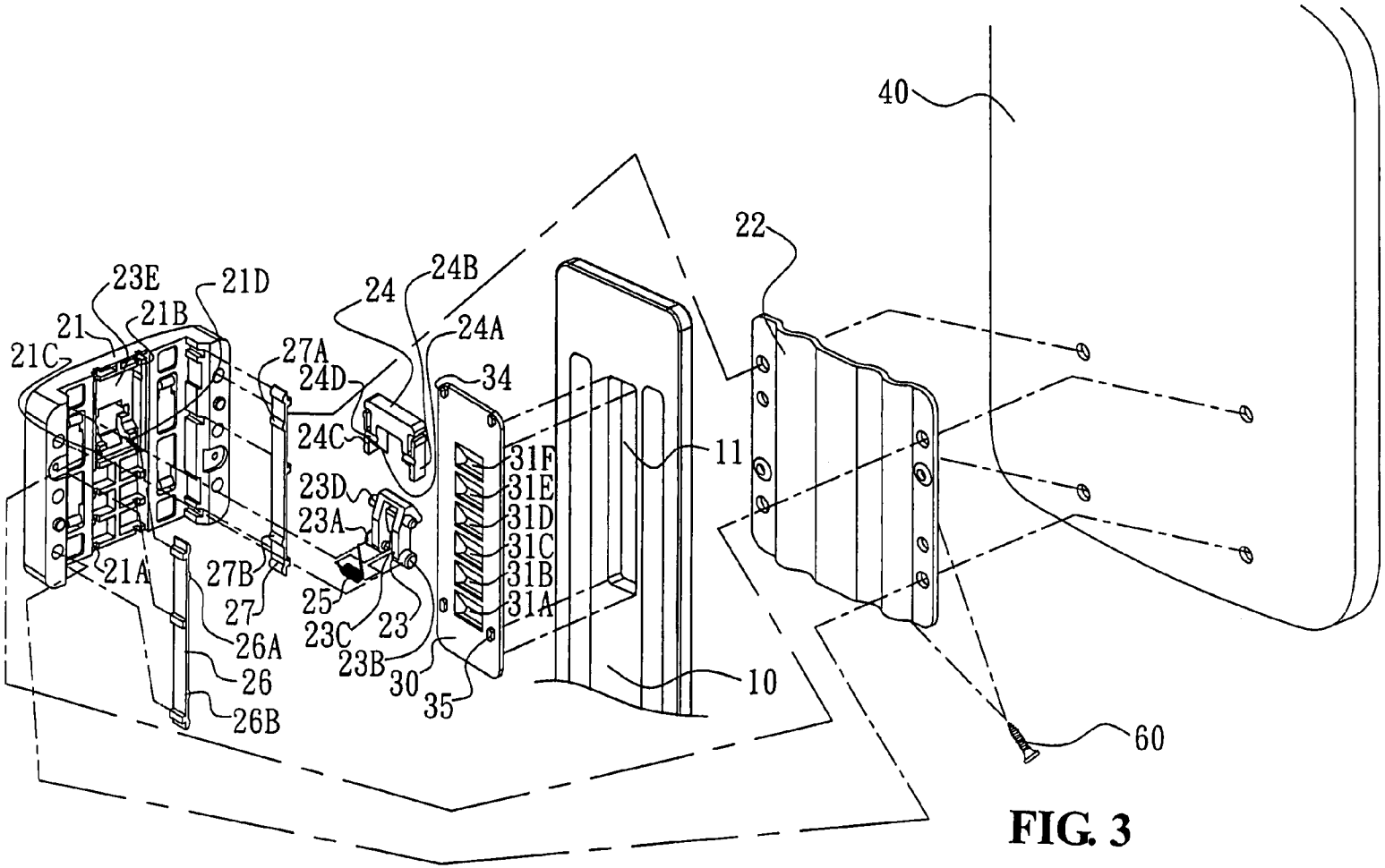
FIG. 3 is a perspective view showing how an embodiment of the present invention is assembled.

FIGS. 1A, 1B and 1C is a perspective view showing the various components making up an embodiment of the present invention. FIG. 2 is a perspective view showing the embodiment of the present invention when it is assembled. FIG. 3 is a perspective view showing how the embodiment of the present invention is assembled. As illustrate, the present embodiment is composed of an L-shape member 10, a sliding member 20, and a multi-step positioning member 30. The sliding member 20 is composed of a body 21, a cover 22, an inverted hook device 23, a stopping block 24, a spring 25, and a pair of sliding plates 26 and 27. The multi-step positioning member 30 is installed in a through opening 11 at an appropriate location in the vertical section of the L-shape member 10. On a side of the multi-step positioning member 30, there are a number of parallel and indented wedging slots 31A, 31B, 31C, 31D, 31E, and 31F. On the same side of the multi-step positioning member 30, there are vertically aligned raised blocks 34 and 35 at an upper part (above the wedging slots) and a lower part (below the wedging slots) of the multi-step positioning member 30 respectively. The L-shape member 10 and the multi-step positioning member 30 could be made by stamping. At an inner side of the body 21, there are notches 21A and 21B allowing the raised blocks 34 and 35 to pass through when the sliding member 20 is slid vertically along the vertical section of the L-shape member 10. The inverted hook device 23 has two axles 23A and 23B at an end sticking out horizontally to the two sides of the inverted hook device 23. The inverted hook device 23 is installed on the body 21 by fitting its two axles 23A and 23B into the two pockets 21C and 21D of the body 21, and is able to pivot around the two axles 23A and 23B and thereby extend out a downward hook (not numbered) at the opposite end to the axles 23A and 23B. Between the two axles 23A and 23B, there is an opening 23C allowing the installation of the spring 25. The spring 25 is configured so that it constantly delivers a force pushing the downward hook to extend out away from the body 21. The downward hook has two ears 23D sticking out horizontally toward the downward hook's two sides.

Also on the inner side of the body 21 and above where the inverted hook device 23 is installed, there is a space 23E for the installation of the stopping block 24. The stopping block 24 has two legs 24B and 24C extended vertically toward the two sides of the inverted hook device 23. Between the two legs 24B and 24C, the stopping block 24 has a slant surface 24A matching the downward hook of the inverted hook device 23. Slightly above the two legs 24B and 24C, and the slant surface 24A, there are troughs 24D matching the two ears 23D of the downward hook of the inverted hook device 23. The two sliding plates 26 and 27 are installed on the body 21 along the two inner walls of the body 21 facing each other from the two sides of the L-shape member 10. On the surfaces of the sliding plates 26 and 27 that face each other, there are a number of bulged, smooth, and rounded ribs 26A, 26B, 27A, and 27B for reducing the friction between the body 21 and the L-shape member 10 when the body 21 is slid up and down along the vertical section of the L-shape member 10. The body 21 and the cover 22 are sealed together to enclose the vertical section of the L-shape member 10 inside by bolts 60. Other types of sealing are also possible.

Figure 4:
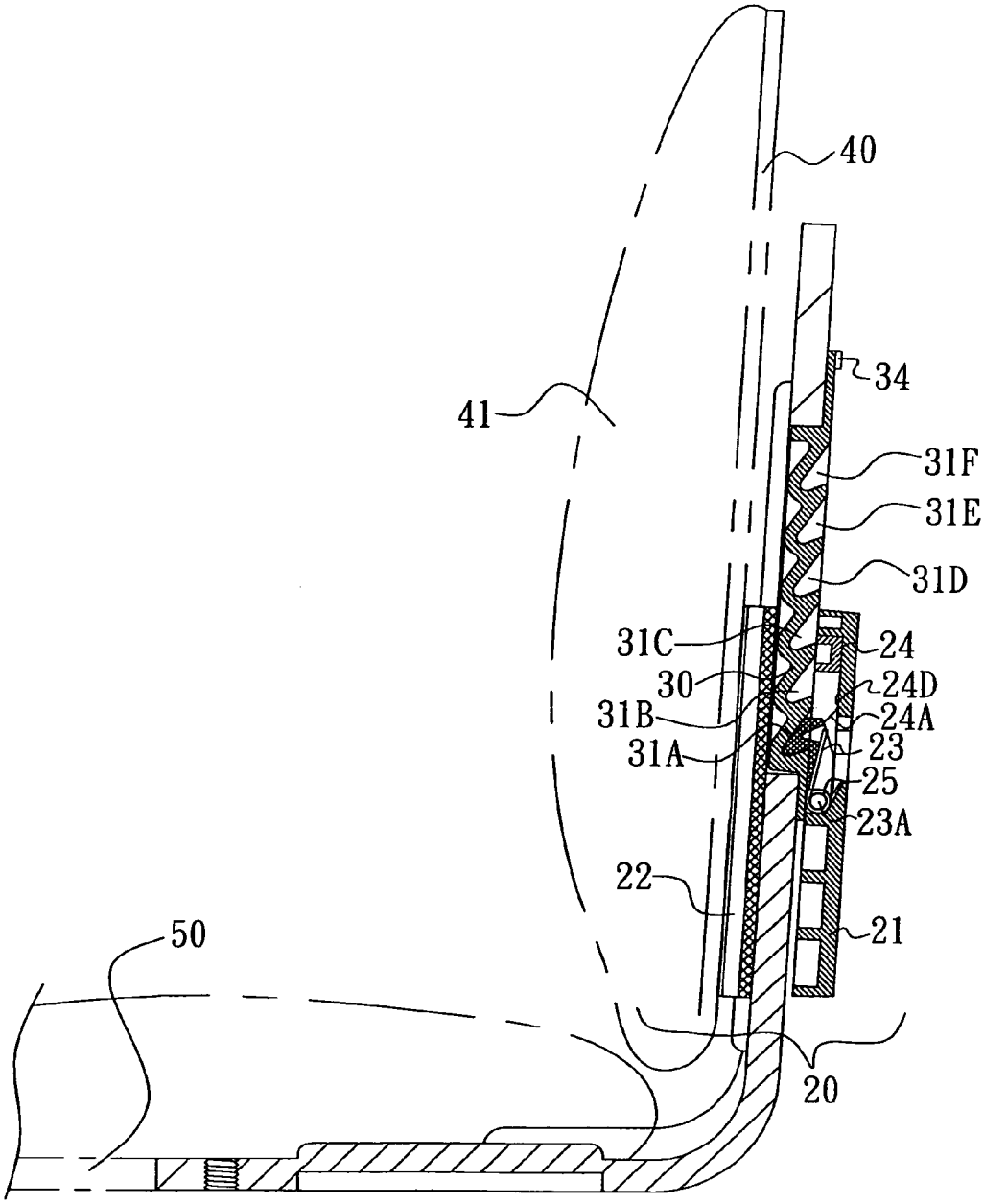
FIG. 4 is a sectional view showing the inside of an embodiment of the present invention.
Figure 5:
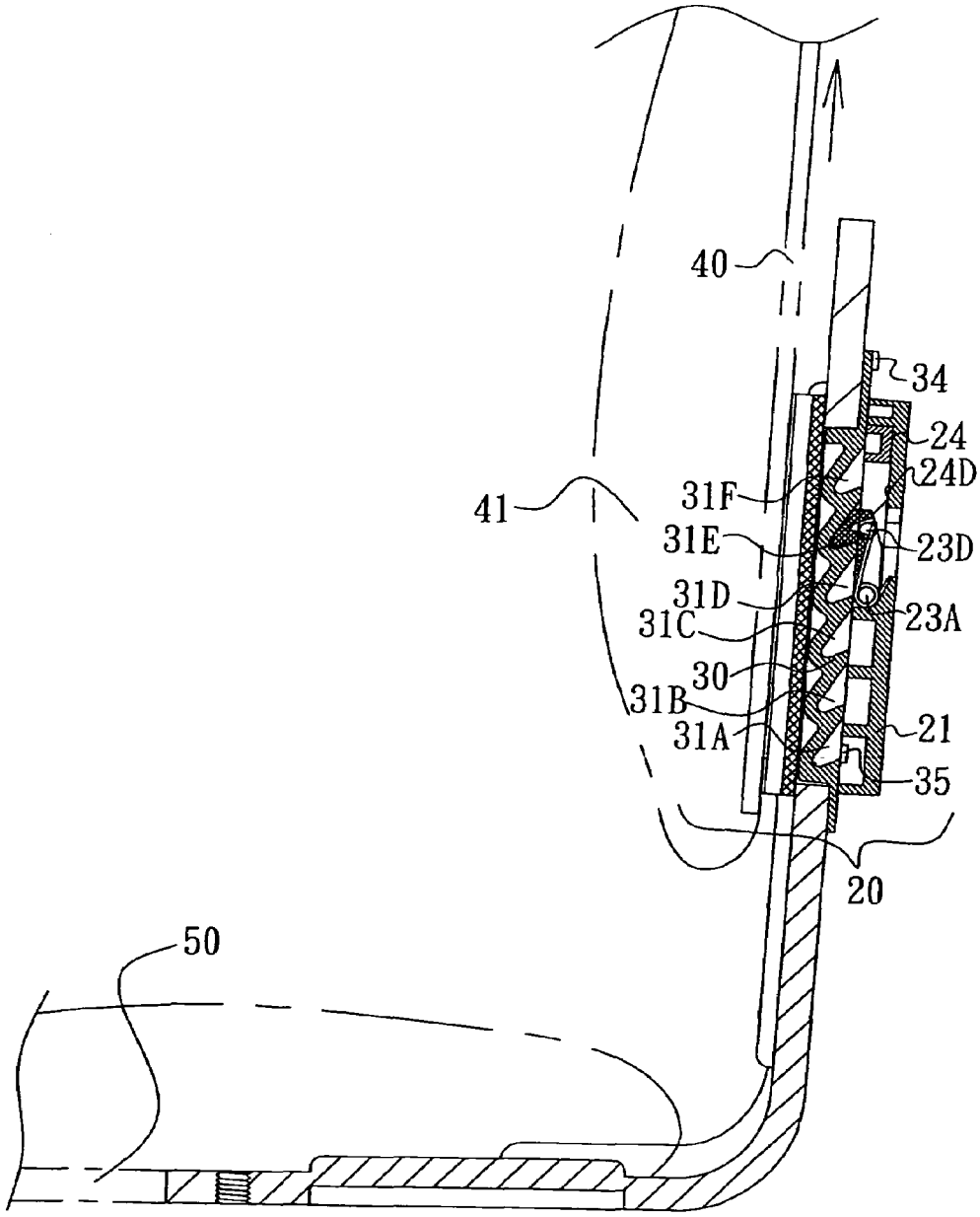
FIG. 5 is a sectional view showing a backrest of an embodiment of the present invention is pulled upward.
Figure 6:
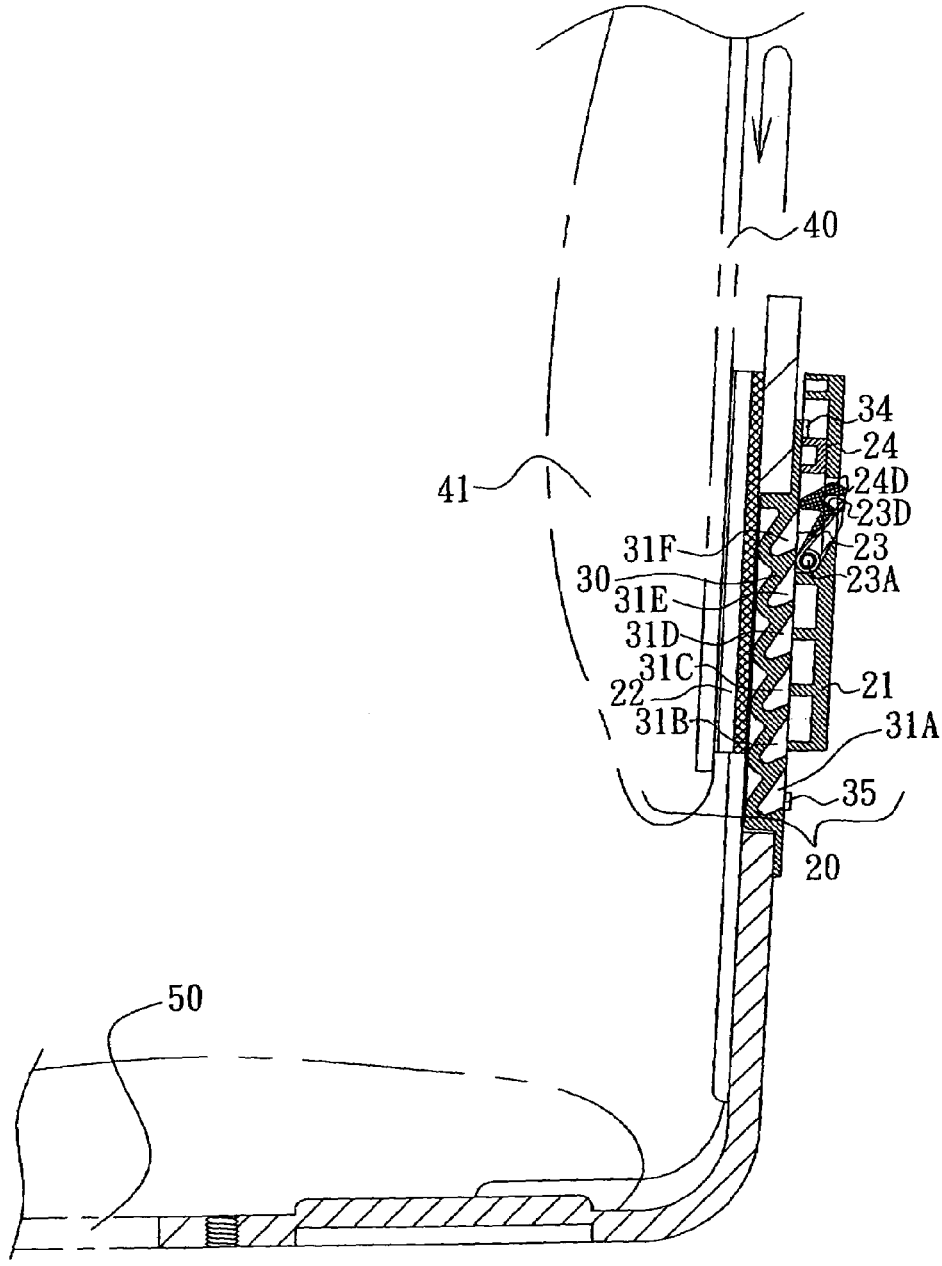
FIG. 6 is a sectional view showing a backrest of an embodiment of the present invention is pulled upward to a topmost position.
Figure 7:
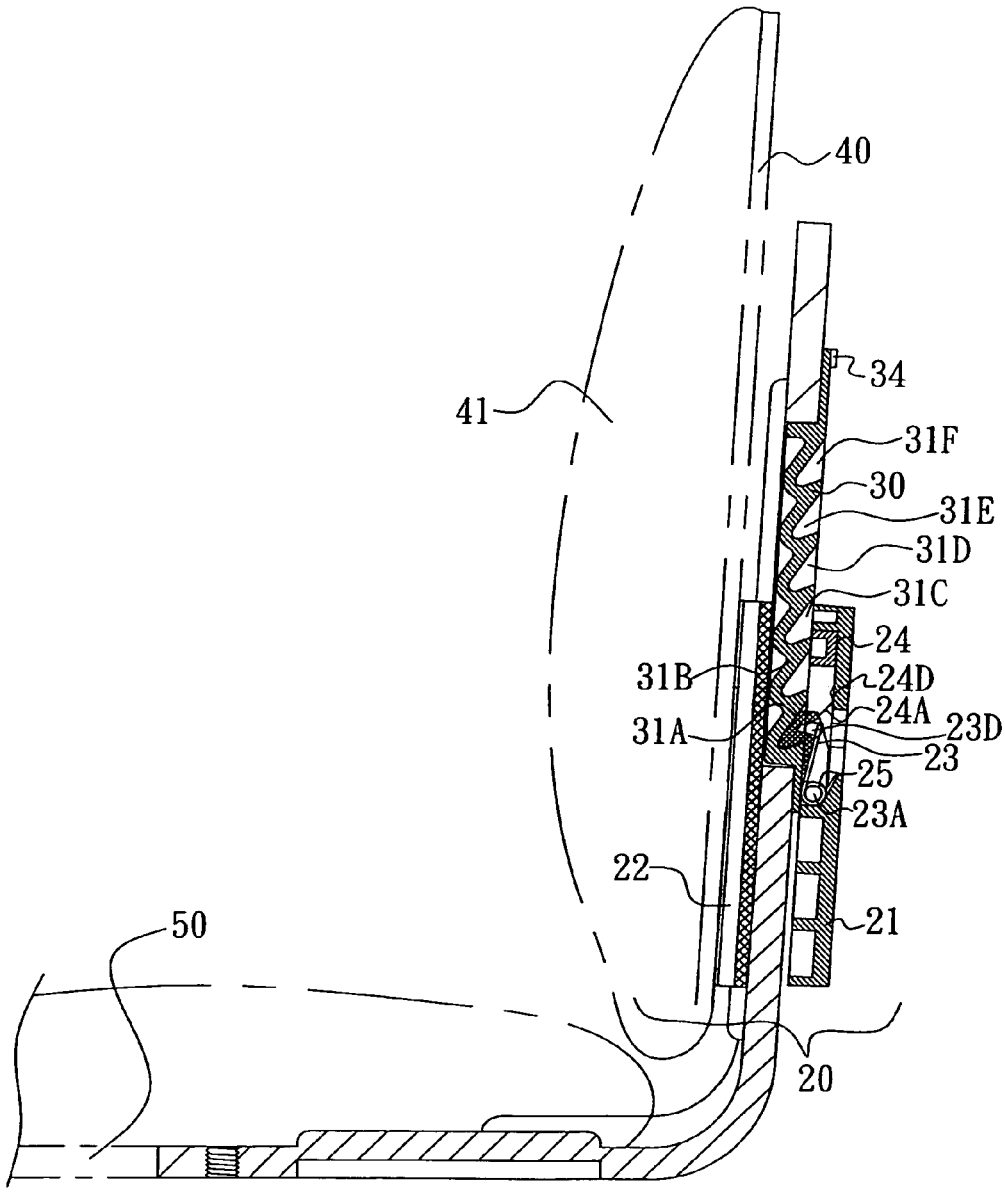
FIG. 7 is a sectional view showing a backrest of an embodiment of the present invention is pushed downward to a bottommost position.

As shown in FIG. 4, the cover 22 is attached to a backrest supporting board 40 and the horizontal section of the L-shape member 10 is attached to the a supporting board 50. To adjust the elevation of the backrest 40, a user simply grab the top rim of the backrest cushion 41 and pull it upward, as illustrated in FIG. 5. As the sliding member 20 is pulled upward along with the backrest supporting board 40, the user pulls the backrest cushion 41 until the inverted hook device 23 is wedged into an appropriate wedging slot, say, 31E, and is fixed at that position. To re-adjust the elevation of the backrest cushion 41, the user first pulls the backrest cushion 41 until the stopping block 24 is pushed downward by the raised blocks 34, as illustrated in FIG. 6. The slant surface 24A of the stopping block 24 raises the downward hook from the wedging slot 31E and the troughs 24D stops the hook ears 23D so that the downward hook of the inverted hook device 23 is prevented from wedging into the wedging slots. The user then pushes the backrest cushion 41 down until the raised blocks 35 lifts the stopping block 24 up. The slant surface 24A and the troughs 24D are therefore removed from stopping the downward hook of the inverted hook device 23. The user then can pull the backrest cushion 41 upward again to a new desired vertical position.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A backrest elevation adjustment assembly for a chair, comprising: an L-shape member, said L-shape member having a horizontal section attached to a seat supporting board of said chair;

a multi-step positioning member having a plurality of parallel indented wedging slots, said multi-step positioning member having at least a top raised block in an appropriate location above the topmost wedging slot and at least a bottom raised block in an appropriate location below the bottommost wedging slot; said multi-step positioning member installed in a through opening in a vertical section of said L-shape member; and a sliding member, said sliding member installed around said vertical section of said L-shape member, said sliding member having an inverted hook device with a downward hook, said downward hook constantly pressed toward said wedging slots, said sliding member having a stopping block at an appropriate location above said inverted hook device, said sliding member attached to a backrest supporting board;

said sliding member comprising:

a body;

a cover;

a spring; and a pair of sliding plates;

wherein a plurality of notches are configured on said body allowing said top and bottom raised blocks to pass through when said sliding member is slid vertically along said vertical section of said L-shape member;

said inverted hook device has two axles at an end sticking out horizontally from the inverted hook device's two sides, said inverted hook device is installed on said body by fitting its two axles into two pockets of said body;

said spring is installed in an opening between said two axles, and is configured so that the spring constantly delivers a force pushing said inverted hook device's downward hook to extend away from said body and toward said wedging slots;

said stopping block is installed in a space above where said inverted hook device is installed;

said sliding plates are installed on said body along two inner walls of said body facing each other from the two sides of said L-shape member; and said body and said cover are sealed together to enclose said vertical section of said L-shape member;

wherein a user grabs said backrest supporting board and pulls the backrest supporting board upward until said inverted hook device is wedged into an appropriate wedging slot so as to fix said backrest supporting board to a specific vertical position;

when said backrest supporting board is pulled to a topmost position, said top raised block pushes said stopping block downward to force said downward hook of said inverted hook device out of said wedging slot and said downward hook is prevented from wedging into said wedging slots; and when said backrest supporting board is dropped to a bottommost position, said bottom raised block raises said stopping block upward to release said downward hook of said inverted hook device and said downward hook is able to wedge into said wedging slots.

2. The backrest elevation adjustment assembly for a chair according to claim 1, wherein said top raised block and said bottom raised block are vertically aligned.

3. The backrest elevation adjustment assembly for a chair according to claim 1, wherein said L-shape member and said multi-step positioning member are made by stamping.

4. The backrest elevation adjustment assembly for a chair according to claim 1, wherein said downward hook has ears at the end opposite to said axles sticking out horizontally toward said downward hook's two sides, said stopping block has a slant surface matching said downward hook of said inverted hook device, said stopping block has legs extended to the two sides of said inverted hook device, and said stopping block has troughs matching said ears of said downward hook of said inverted hook device slightly above said legs and said slant surface.

5. The backrest elevation adjustment assembly for a chair according to claim 1, wherein the surfaces of said sliding plates facing each other have a plurality of bulged, smooth, and rounded ribs.

* * * * *